United States Patent [19]

Campi et al.

[11] Patent Number: 4,485,362

[45] Date of Patent: Nov. 27, 1984

[54] VARIABLE MICROWAVE STRIPLINE POWER DIVIDER

[75] Inventors: Morris Campi; Frederick Farrar; Daniel Shames, all of Silver Spring, Md.

[73] Assignee: The United States of America as represented by the Secretary of the Army, Washington, D.C.

[21] Appl. No.: 437,607

[22] Filed: Oct. 29, 1982

[51] Int. Cl.³ ..... H01P 5/04

[52] U.S. Cl. ..... 333/128; 333/104; 333/246

[58] Field of Search ..... 333/104, 120, 128, 136, 333/81 A, 263

[56] References Cited

U.S. PATENT DOCUMENTS 4,302,734 11/1981 Stockton et al. ..... 333/104

4,323,855 4/1982 Gerlach ..... 333/128 X 4,420,839 12/1983 Hogerheiden, Jr. ..... 333/120 X

*Primary Examiner*—Paul L. Gensler

*Attorney, Agent, or Firm*—Anthony T. Lane; Robert P. Gibson; Saul Elbaum

[57] ABSTRACT

A variable microwave stripline power divider, in which the power seen at each of two outputs can be varied over a wide range without appreciably changing the power seen at the other output. In one embodiment, this is accomplished mechanically by shorting posts connecting the patch member to a ground plane member of the device at selected points. In another embodiment of the invention, this is accomplished electronically by a plurality of electronic switching devices connected between a like plurality of patch member shorting points and a ground plane member, which are selectively activated by a microcomputer.

13 Claims, 8 Drawing Figures

FIG. 3
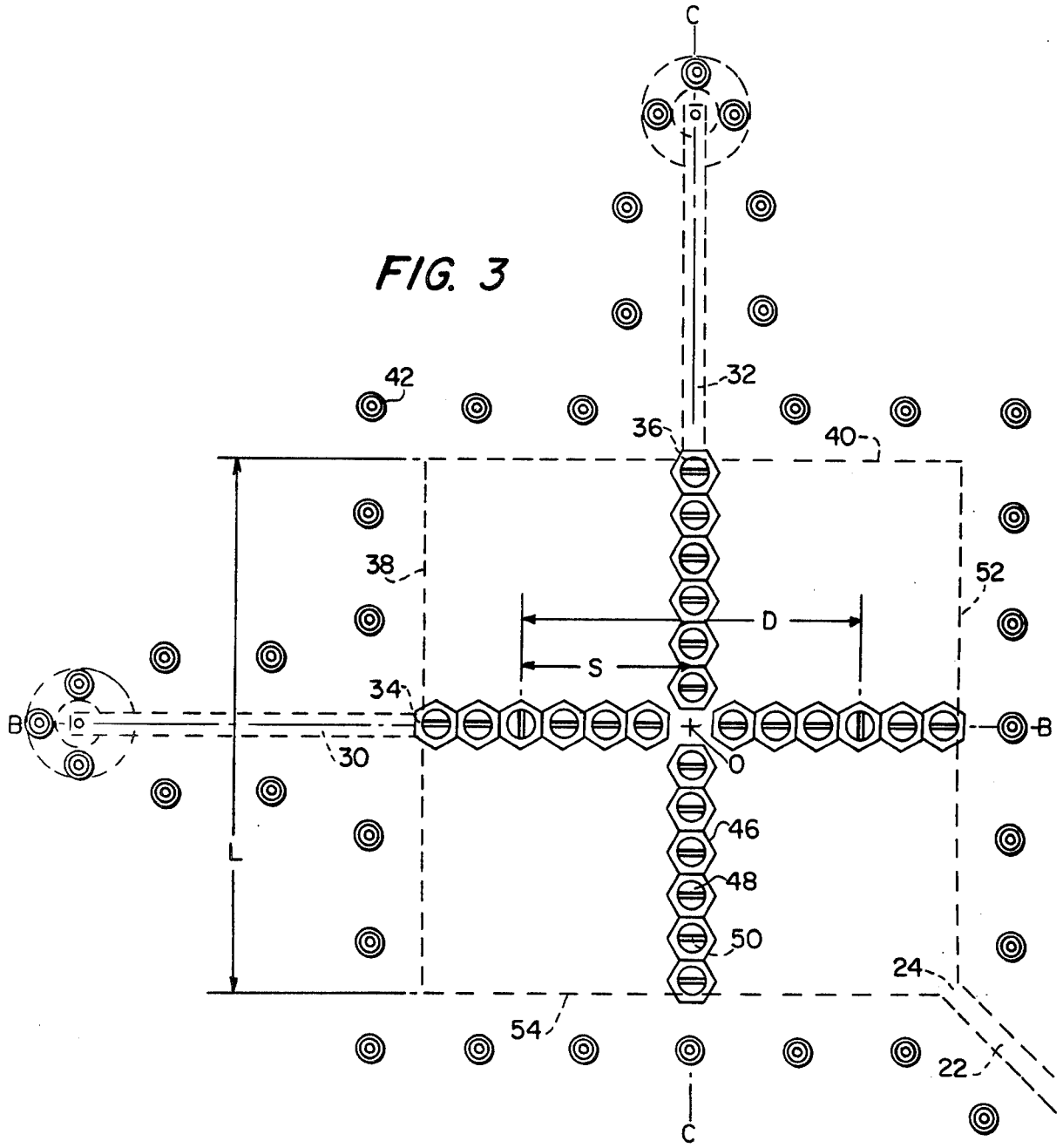
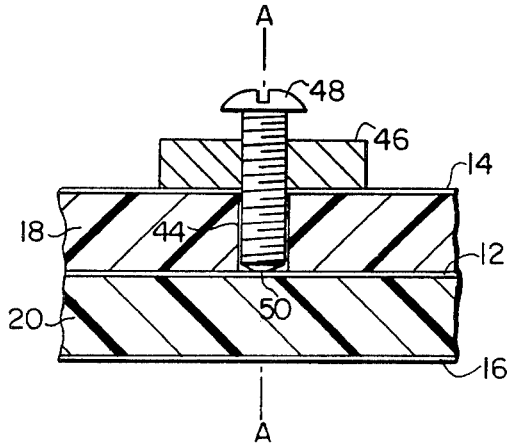
FIG. 4

VARIABLE MICROWAVE STRIPLINE POWER DIVIDER

RIGHTS OF THE GOVERNMENT

The invention described herein may be manufactured and used by or for the United States Government for governmental purposes without payment to us of any royalty thereon.

BACKGROUND OF THE INVENTION

The invention relates generally to three port microwave power dividers, and, in particular, to a stripline type of microwave power divider.

In the past, the most commonly used microwave power dividers, such as the magic tee or hybrid power divider and the Wilkinson power divider, have been individually designed and constructed to achieve specific fixed divisions of the input microwave power at the two output ports of these devices. Once one of these known microwave power dividers has been designed and constructed to achieve a specific power split, it cannot thereafter be changed to give a different power split. For example, if a magic tee or Wilkinson power divider has been designed and constructed to achieve a 3/3 dB power split in which one-half of the input power is seen at each of the two output ports, it can not thereafter be changed to achieve a 6/1.25 dB split, in which one-fourth and three-fourths of the input power is seen at the two output ports, respectively. Thus, to change the power split in an existing microwave system, it was necessary to replace a fixed microwave power divider in the system with another, individually designed, fixed microwave power divider.

SUMMARY OF THE INVENTION

Therefore, it is a primary object of the invention to provide a three-port microwave power divider, in which the ratio of the input power seen at one output port to that seen at the other output port can be varied over a wide range. Such a variable microwave power divider could be used in place of many individually designed and constructed fixed microwave power dividers, thus greatly reducing the design and construction time for microwave systems.

It is a further object of the invention to provide a variable microwave stripline power divider which includes a simple mechanism for quickly and easily changing the power split to a selected one of a wide range of possible values. It is a related object of the invention that the power split can be steplessly varied by this mechanism.

It is another object of the invention to provide a variable microwave stripline power divider which includes electronic devices and circuitry for varying the power split over a wide range. It is a related object of the invention that the power split can be varied approximately sinusoidally at a selected frequency as high as several KiloHertz by the electronic devices and circuitry.

A variable microwave stripline power divider, according to the invention includes an electrically-conductive planar patch member, at least one electrically-conductive planar ground plane member which is disposed adjacent to and spaced from the patch member in a plane parallel to the plane of the patch member, and a dielectric material which is disposed about the patch member between the patch member and each ground plane member. The patch member includes an input and first and second outputs which are disposed at the perimeter of the patch member and are spaced from each other. The dielectric material and the dimensions of the patch member are selected such that the patch member behaves as a resonant cavity for a microwave signal of given frequency supplied to its input.

The patch member includes a plurality of contact points which are selectively connectable to a first ground plane member, either by mechanical devices such as shorting posts which are insertable within holes or slots formed through the first ground plane member and the dielectric material, or by electronic switching devices such as microwave PIN switching diodes which are connected between the first ground plane member and the patch member contact points, respectively. The connection of one or more of the patch member contact points to the first ground plane member will add inductive impedance and produce an increase in the transmission loss of at least one of the patch member outputs. Thus, by selecting and connecting one or more of the patch member contact points to the first ground plane member, the transmission loss at one output can be increased more than the transmission loss at the other output, so as to effect a desired power split between the two outputs.

In a preferred embodiment for the invention, the patch member has a square perimeter which is approximately twice the wavelength of the microwave signal in the dielectic material whereby the patch member includes orthogonally intersecting first and second axes along which the E field magnitude is zero when the E field amplitude at the patch member input is maximum. The patch member first and second outputs are disposed respectively on the first and second axes on opposite sides of the patch member center from the patch member input. One portion of the patch member contact points are disposed along the first axis, and the remaining contact points are disposed along the second axis such that each contact point is spaced in one axial direction from the center of the patch member by the same distance as a corresponding oppositely-disposed contact point is spaced in an opposite axial direction from the center of the patch member.

In this preferred arrangement, when none of the patch member contact points are connected to the first ground plane member, the microwave power will be evenly split between the two outlets of the patch member. The connection to the first ground plane member of one or more contact points disposed along one axis will produce an increase in the transmission loss at the patch member outlet disposed on the one axis without producing a corresponding increase in the transmission loss at the patch member outlet disposed on the other axis. If two corresponding, oppositely-disposed contact points on the same axis are connected to the first ground plane member, the transmission loss at the output disposed on the same axis will be increased as a function of the distance of these two contact points from the center of the patch member. Thus, the power split between the two patch member outputs can be varied between very wide limits by connecting various contact points of the patch member to the first ground plane member.

The invention will be better understood and further features and advantages will become apparent from the following description of preferred embodiments, taken together with the drawings.

BRIEF DESCRIPTION OF THE DRAWINGS

FIG. 3 is a plan view of the patch member, showing the disposition of patch member shorting points.

FIG. 4 is a partial, cross sectional view of the embodiment of FIG. 1, showing a single shorting screw.

DESCRIPTION OF PREFERRED EMBODIMENTS

Figure 1:
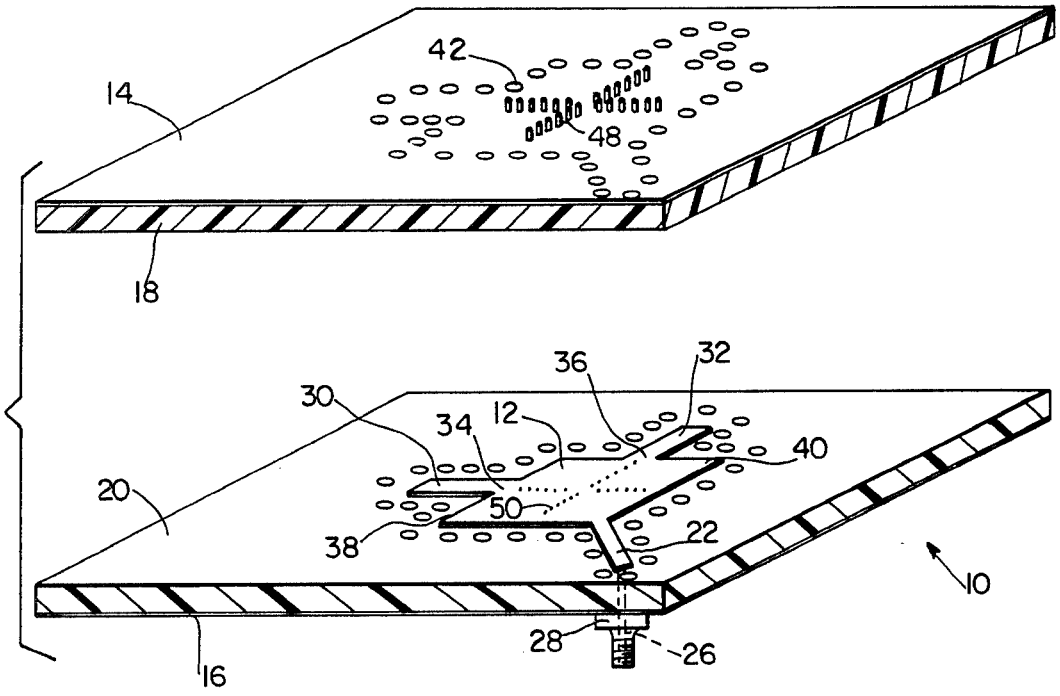
FIG. 1 is a simplified, exploded, perspective view of a variable microwave stripline power divider, according to the invention.
Figure 2:
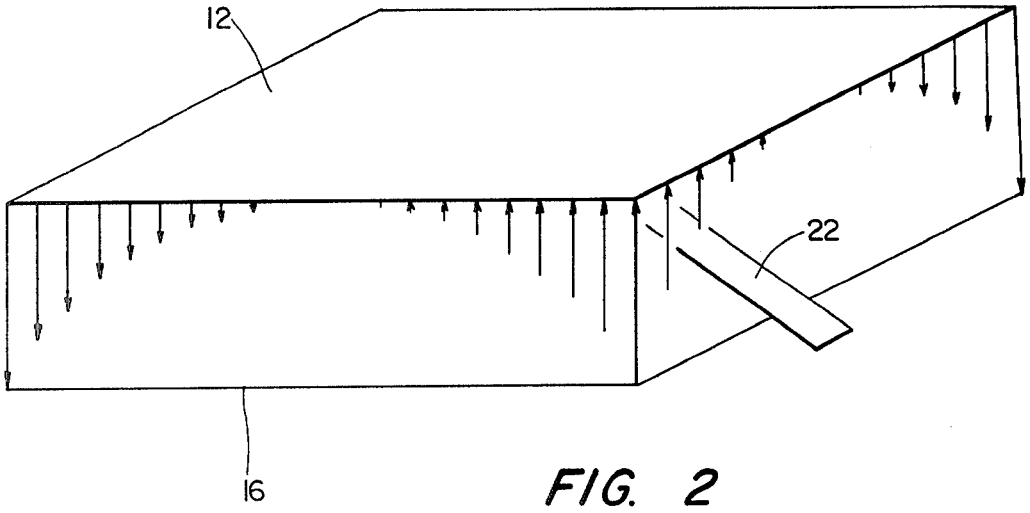
FIG. 2 is a representation of the E field distribution in the dielectric material between one ground plane member and a square patch member of the embodiment shown in FIG. 1.

The variable power divider 10 shown in FIGS. 1–4 includes an electrically conductive planar patch member 12 which is disposed between, and in parallel arrangement with, two electrically conductive planar ground plane members 14, 16. The patch member 12 is spaced from the first ground plane member 14 by a first dielectric substrate 18, and is spaced from the second ground plane member 16 by a second dielectric substrate 20.

The patch member 12 includes an input transmission line 22 in the form of a conductive strip extending from a first corner 24 of the patch member 12 to the center conductor 26 of a coaxial connector 28 disposed on the outer surface of the second ground plane member 16. The patch member 12 also includes first and second output transmission lines 30, 32 in a form of conductive strips extending respectively from the midpoints 34, 36 of first and second sides 38, 40 of the patch member 12 opposite the first corner 24. The first and second output transmission lines 30, 32 are connected to the center conductors of respective coaxial connectors (not shown), which are disposed on the outer surface of the second ground plane member 16 and are similar or identical to the coaxial connector 28.

The various planar elements 12–20 of the power divider 10 are held together by a plurality of screws or rivets 42 extending through these elements. These screws or rivets 42 are disposed uniformly about the perimeter of the patch member 12 and lines 22, 30, 32 to suppress rf radiation from these elements 12, 22, 30, 32.

The power divider 10 also includes a plurality of bores 44 extending through the first ground plane member 14 and the first dielectric substrate 18 to the patch member 12. A like plurality of threaded nuts 46 are affixed to the outer surface of the first ground plane member 14 in concentric arrangement with the bores 44, respectively. A plurality of shorting screws 48 are threadingly engaged with the nuts 46, respectively. As each shorting screw 48 is rotated in one direction about the bore axis A—A, it is dispaced along this axis A—A to connect one of a plurality of contact points 50 of the patch member 12 with the first ground plane member 14.

The patch member contact points 50, which are individually connectable by the shorting screws 48 to the first ground plane member 14, are disposed along first and second axes B—B, C—C, of the patch member 12 which intersect orthogonally at the center 0 of the patch member 12. The first axis B—B extends through midpoints of the first side 38 and an opposite third side 52 of the patch member 12. The second axis C—C extends through the midpoints of the second side 40 and an opposite fourth side 54 of the patch member 12. Each patch member contact point 50 is spaced in one axial direction from the center 0 of the patch member 12 by the same distance as a corresponding oppositely-disposed patch member contact point 50 is spaced in an opposite axial direction from the center 0 of the patch member 12.

When none of the patch member contact points 50 are connected to the first ground plane member 14, the patch member 12 behaves as a resonant cavity at a frequency $f_o$ such that one-half the wavelength in the dielectric is approximately equal to the length L of one side of the patch member 12. That is, $$f_o = \frac{c}{2L\sqrt{\epsilon}}$$

where $L \simeq \lambda/2$, c=speed of light in free space, and $\epsilon$ is the dielectric constant.

It is well known that a rectangular end-fed patch will resonate along one dimension of the patch. The TEM mode is excited, and therefore the E field distribution is sinusoidal, with its amplitude being maximum and of opposite sign at the patch edges, and zero amplitude on the centerline of the rectangular patch. However, in the embodiment described above and shown in FIGS. 1–4, since the square patch member 12 is completely symmetrical with respect to resonant dimension and feed point 24, the E field at any point on the patch member 12 is the vector sum of two orthogonal distributions, as illustrated in FIG. 2.

The connection of any of the patch member contact points 50 to the first ground plane member 14 adds inductive impedance to the circuit, thereby changing the frequency of the two orthogonal TEM modes. Generally, it is preferable to connect a pair of corresponding, oppositely disposed, patch member contact points 50 which are disposed on the same axis B—B, C—C, equidistance from the patch member center 0, rather than a single contact point 50, to avoid the introduction of cross-polarized signals. For example, if a pair of corresponding patch member contact points 50 disposed on the first axis B—B are connected to the first ground plane member 14 by their respective screws 48, the frequency of the mode along the direction of the first axis B—B will be increased as a function of the distance D between the two shorted contact points 50 (or the distance S from the patch center 0 to one of these shorted contact points 50), whereas the mode along the direction of the second axis C—C will be essentially unchanged. Consequently, by changing the shorting post positions, a change in power will be seen at the two outputs 30, 32 of the patch member 12.

Figure 5:
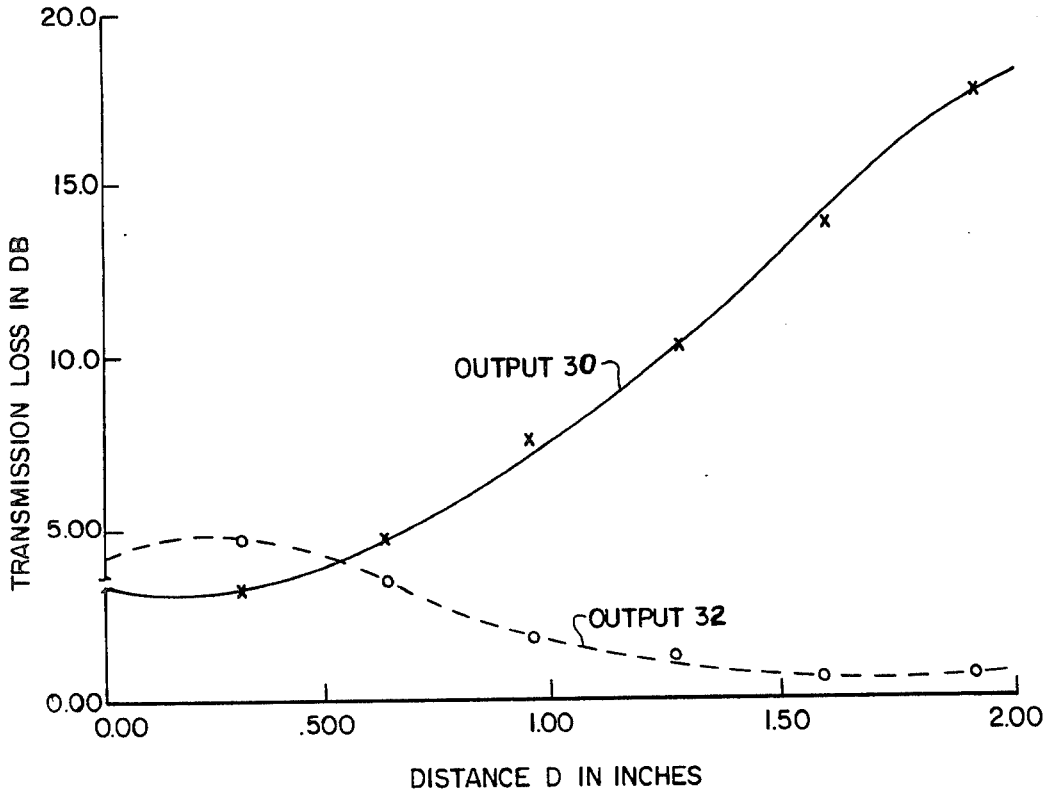
FIG. 5 is a graph showing the transmission loss of the two patch member outputs as a function of the distance between two corresponding, oppositely disposed, contact points connected to a ground plane member of the power divider.

This is illustrated in the graph of FIG. 5, in which the transmission loss of the first and second patch outputs 30, 32 is plotted against the distance between two corresponding shorted patch member contact points symmetrically disposed on the first axis B—B of a variable microwave power divider 10 in which the dielectric material and the dimensions of the patch member 12 were selected such that the patch member 12 behaves as a resonant cavity for a microwave signal having a frequency of 1.85 GHz. In this power divider, the dielectric substrates 18, 20 were formed from 0.0625 inch thick fiberglass—Teflon material, with a dielectric constant of 2.49. The patch member 12 and the first and second ground plane members 14, 16 were formed from 0.0014 inch thick copper plate. The length of each side of the square patch member 12 was 2 inches, and the three transmission lines 22, 30, 32 of the patch member 12 were 1.3 inches long and 0.088 inches wide, with an impedance of 50 ohms. The screws 42 for holding the various planar elements 12–20 together and for suppressing rf radiation were placed 0.2 inches around the perimeter of the patch member 12 and lines 22, 30, 32 at 0.4 inch intervals. The bores 44, and consequently, the patch member contact points 50, were disposed along the two axes B—B, C—C symmetrically about the patch member center 0 in 0.16 inch increments.

To obtain the data necessary for the graph shown in FIG. 5 and verify symmetrical behavior of the power divider 10, corresponding pairs of patch member contact points 50 symmetrically disposed on the same axis B—B or C—C were sequentially grounded to the first ground plane member 14. A Hewlett-Packard network analyzer system was used to measure reflection and transmission characteristics of the power divider 10 for each pair of grounded patch member contact points.

It was initially observed that the power divider 10 behaved symmetrically. To illustrate, if two grounded contact points 50, disposed a given distance D apart on the first axis B—B symmetrically about the center 0, produced an increase in the transmission loss of the patch member first output 30, then two grounded contact points, disposed the same distance D apart on the second axis C—C symmetrically about the center 0, produced the same increase in the transmission loss of the patch member second output 32.

Further measurement revealed that as the two grounded contact points 50 disposed on the first axis B—B symmetrically about the center 0 were moved outward to increase the distance between these points, the amount of coupling to the patch member first output 30 varied from 3.5 dB to 17.5 dB, and the coupling to the patch member second output 32 varied from about 4.0 dB to 1.0 dB, as shown in FIG. 5. Additionally, the voltage standing wave ratio VSWR was better than 1.8:1 in each case. Grounding of the two patch member contact points 50 along the first axis B—B closest to the center 0 produced little change in the transmission losses of the patch member first and second outputs 30, 32, and the isolation for these points was only about 6.00 dB. However, the transmission loss of the path member first output 30 thereafter rapidly increased as the distance between the grounded contact points increased and the isolation increased from 9.5 dB at a grounded contact point spacing of 0.96 inches to 18.25 dB at a grounded contact point spacing of 1.92 inches.

Figure 7:
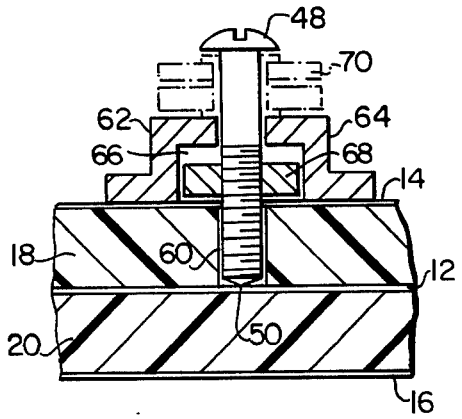
FIG. 7 is a partial cross sectional view of the embodiment shown in FIG. 6.
Figure 6:
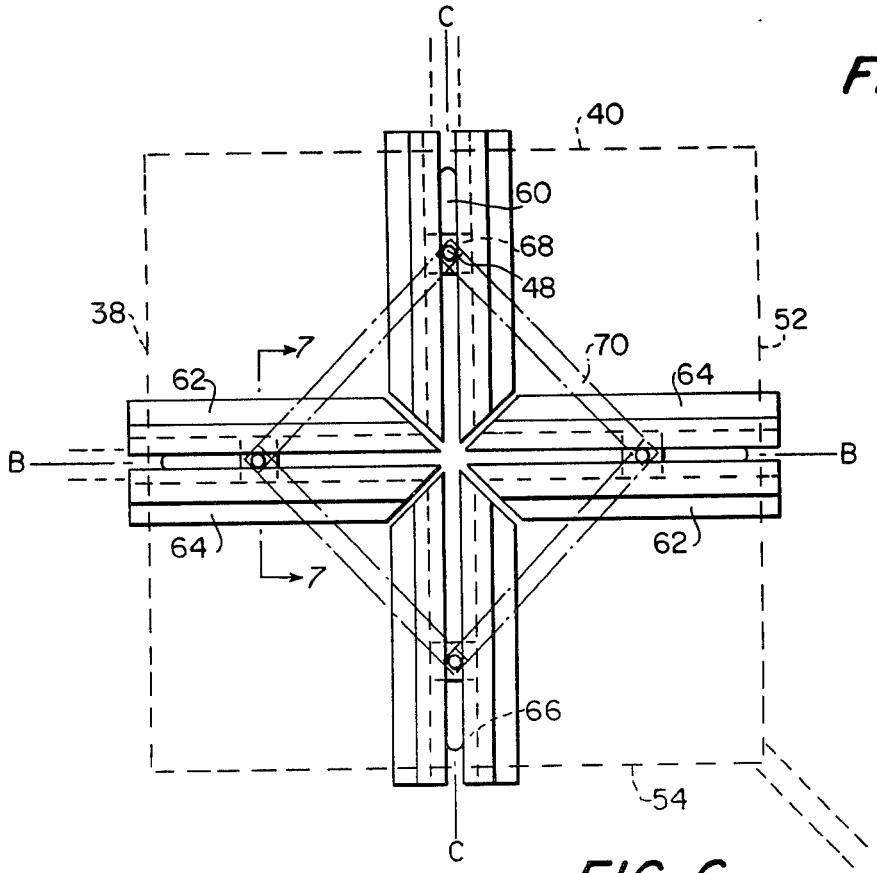
FIG. 6 is a plan view of another embodiment of the invention.

FIGS. 6 and 7 show a variation of the variable power divider 10 shown in FIG. 1, in which the distance between the two patch member contact points 50 connected to the first ground plane member 14 can be varied continuously, rather than in increments. In this variation, the bores 44 are replaced by four slots 60 which extend through the first ground plane member 14 and the dielectric substrate 18 to the patch member 12. The four slots 60 extend outwardly from the patch member center 0 to slot ends adjacent the midpoints of the four sides 38, 40, 52, 54, respectively, of the patch member 12, two slots 60 extending along the first axis B—B and the other two slots 60 extending along the second axis C—C. Four sets of guide members 62, 64, are fixed to the first ground plane member 14 and are disposed on opposite sides of the slots 60, respectively. Each pair of guide members 62, 64 define a guidance channel 66 for a square threaded nut 68 and a shorting screw 48 threadingly engaged with the square nut 68. Each shorting screw 48 can be rotated in one direction of rotation to first connect the patch member 12 with the first ground plane member 14, and then to secure the shorting screw 48 in this position by the engagement of the square nut 68 with the guide member 62, 64. When the shorting screw 48 is rotated in an opposite direction of rotation to unlock and disengage the shortening screw 48 from the patch member 12, the assembly of the square nut 68 and the shorting screw 48 is freely slideable along the length of the slot 60 and the guidance channel 66.

Since only two of the four shorting screws 48, disposed along the same axis B—B or C—C, are connected at any one time to the patch member 12, the four shorting screws 48 may be mechanically connected so that each pair of shorting screws 48 disposed along the same axis are always maintained equidistant from the patch member center 0. This can be accomplished by any one of many known mechanisms. For example, the four shorting screws 48 may be pivotally connected to four identical insulating links 70 of a four bar linkage, as shown by dash-dot lines in FIG. 6.

Figure 8:
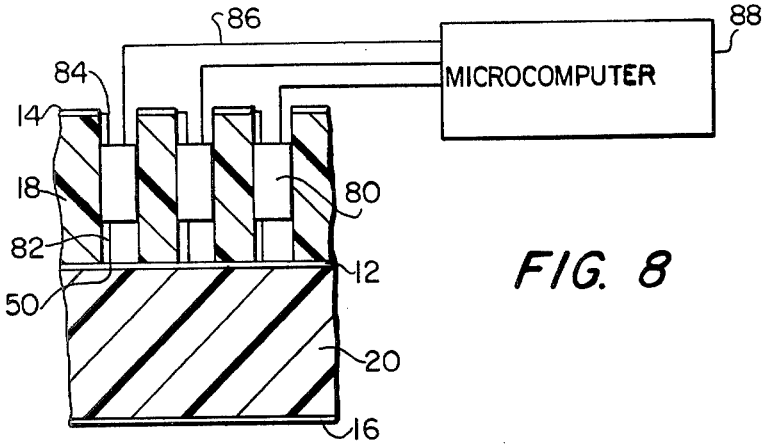
FIG. 8 is a partial cross sectional view of a third embodiment, taken along a patch member axis B—B or C—C.

In another variation of the variable power divider 10, shown in FIG. 8, the shorting screws 48 and nuts 46 are replaced by microwave PIN switching diodes 80 which are disposed in the bores 44, respectively. Each switching diode 80 has one line terminal or lead 82 connected to the adjacent patch member contact point 50, a second line terminal or lead 84 connected to the first ground plane member 14, and a control terminal or lead 86 connected to receive a control signal from a microcomputer 88 which determines the electrical conductivity of the switching diode 80 between the two output terminals or leads 82, 84. The microcomputer 88 can be programmed to vary the microwave power outputs of the patch member 12 in sinusoidal fashion at a relatively high frequency, for example, several kiloHertz. Such electronically controlled, variable microwave power dividers can be advantageously used for many applications in microwave systems. For example, they can be used in a microwave antenna system to vary the microwave power to an array of antenna elements for the purpose of null steering.

There are many variations and modifications of the variable microwave power divider disclosed herein which would be obvious to one skilled in the art. For example, the periphery of the patch member 12 could be circular rather than square, or, when a square patch member 12 is used, the input could be disposed at a midpoint of one side, and the two outputs could be disposed at the two opposite corners of the patch. It is only essential that the dielectric material and the dimensions of the patch member 12 be selected such that the patch member 12 behaves as a resonant cavity for a microwave signal of given frequency supplied to the patch member input, in which case, the patch member 12 will always include a locus of points which may be grounded to increase the frequency of the mode along one direction without essentially changing the frequency of the mode along another direction.

In view of the many obvious modifications, variations, and additions which can be made to the above-described invention by persons skilled in the art, it is intended that the scope of this invention be limited only by the appended claims.

What is claimed and desired to be secured by Letters Patent of the United States is:

1. A variable microwave stripline power divider, which comprises:

an electrically-conductive planar patch member which includes a plurality of contact points and a perimeter, the perimeter including an input, a first output spaced from the input, and a second output spaced from the input and the first output;

at least one electrically-conductive planar ground plane member which is disposed adjacent to and spaced from the patch member in a plane parallel to the plane of the patch member;

a dielectric material disposed about the patch member and between the patch member and the at least one ground plane member, the dielectric material and the dimensions of the patch member being selected such that the patch member behaves as a resonant cavity for a microwave signal of given frequency supplied to the patch member input;

signal input means for feeding said microwave signal to the patch member input;

first signal output means for feeding out of the patch member a first microwave output signal appearing at the patch member first output;

second signal output means for feeding out of the patch member a second microwave signal appearing at the patch member second output; and adjustable means for determining the coupling to at least one of the two patch member outputs, which includes connecting means for electrically connecting the at least one ground plane member with at least one patch member contact point selected from the plurality of patch member contact points.

2. A variable microwave stripline power divider, as described in claim 1, wherein:

said at least one ground plane member includes a first ground plane member disposed on one side of the patch member;

said adjustable means further comprises a plurality of passages defined by and extending through the first ground plane member and the dielectric material to the patch member contact points, respectively; and said connecting means comprises at least one electrically-conductive shorting post which is insertable into a selected one of said passages to electrically connect the first ground plane member with the adjacent patch member contact point.

3. A variable microwave stripline power divider, as described in claim 2, wherein said at least one shorting post comprises a plurality of shorting posts respectively disposed within a like plurality of said passages in threading engagement with the first ground plane member so that each shorting post is rotatable in one direction of rotation to electrically connect the adjacent patch member contact point with the first ground plane member and is rotatable in an opposite direction of rotation to electrically disconnect the adjacent patch member contact point from the first ground plane member.

4. A variable microwave stripline power divider, as described in claim 1, wherein:

said at least one ground plane member includes a first ground plane member disposed on one side of the patch member;

said connecting means comprises a plurality of electronic switching devices within the dielectric material between the first ground plane member and respective patch member contact joints, each switching device including two opposite line terminals connected respectively to the first ground plane member and to the adjacent patch member contact point and a control terminal for receiving an electrical control signal which determines the electrical conductivity between the two line terminals of the switching device; and control means, having a plurality of outputs connected respectively to the switching device control terminals, for supplying control signals to the switching devices to render conductive at least one selected switching device.

5. A variable microwave stripline power divider, as described in claim 4, wherein said switching devices are microwave PIN switching diodes.

6. A variable microwave stripline power divider, as described in claim 1, wherein:

the patch member perimeter is formed as a square, each side of the square having a length which is approximately equal to one-half the wavelength of the microwave signal in the dielectric material;

the patch member input is disposed at a first corner of the square perimeter;

the patch member first output is disposed at the midpoint of a first side of the square perimeter opposite the first corner;

the patch member second output is disposed at the midpoint of a second side of the square perimeter opposite the first corner; and the patch member contact points are disposed along at least one axis of two patch member axes, namely, a first axis extending through the midpoints of the first perimeter side and an opposite third perimeter side and a second axis extending through the midpoints of the second perimeter side and an opposite fourth perimeter side, the first and second axes intersecting orthogonally at the center of the square patch member.

7. A variable microwave stripline power divider, as described in claim 6, wherein:

said at least one ground plane member includes a first ground plane member disposed on one side of the patch member;

said adjustable means further comprises at least one axially-extending slot defined by and extending through the first ground plane member and the dielectric material to the patch member contact points; and said connecting means comprises at least one shorting post which is disposed within each slot in sliding contact with the first ground plane member and the patch member for movement along the slot.

8. A variable microwave striplined power divider, as described in claim 6, wherein each contact point is spaced in one axial direction from the center of the patch member by the same distance as a corresponding oppositely-disposed contact point is spaced in an opposite axial direction from the center of the patch member.

9. A variable microwave stripline power divider, as described in claim 8, wherein a first portion of the contact points are disposed on the first axis and the remaining contact points are disposed on the second axis.

10. A variable microwave stripline power divider, as described in claim 9, wherein:

said at least one ground plane member includes a first ground plane member disposed on one side of the patch member;

said adjustable means further comprises four slots which are defined by and extend through the first ground plane member and the dielectric material to the patch member contact points, the four slots including a first slot extending along the first axis between the patch member center and the first perimeter side, a second slot extending along the second axis between the patch member center and the second perimeter side, a third slot extending along the first axis between the patch member center and the third perimeter side, and a fourth slot extending along the second axis between the patch member center and the fourth perimeter side; and said connecting means includes four electrically conductive shorting posts which are disposed respectively within the four slots in sliding contact with the first ground plane member for movement along the slot axis, each shorting post having an axis orthogonal to the slot axis and each shorting post being movable along its axis to electrically connect or disconnect the first ground plane member and the adjacent patch member contact point, and each shorting post including securing means for maintaining the shorting post in a selected position within the slot.

11. A variable microwave stripline power divider, as described in claim 9, wherein:

said at least one ground plane member includes a first ground plane member disposed on one side of the patch member;

said adjustable means further comprises a plurality of passages defined by and extending through the first ground plane member and the dielectric material to the patch member contact points, respectively; and said connecting means comprises a plurality of shorting posts which are respectively insertable into a like plurality of said passages in threading engagement with the first ground plane member so that each shorting post is rotatable in one direction of rotation to electrically connect the adjacent patch member contact point with the first ground plane member and is rotatable in an opposite direction of rotation to electrically disconnect the adjacent patch member contact point from the first ground-plane member.

12. A variable microwave stripline power divider, as described in claim 9, wherein:

said at least one ground plane member includes a first ground plane member disposed on one side of the patch member;

said connecting means comprises a plurality of electronic switching devices disposed within the dielectric material between the first ground plane member and respective patch member contact points, each switching device including two line terminals connected respectively to the first ground plane member and to the adjacent patch member contact point and including a control terminal for receiving an electrical control signal which determines the electrical conductivity between the two line terminals; and control means for supplying control signals to the switching devices so as to render conductive a selected pair of switching devices connected to corresponding oppositely-disposed patch member contact points disposed on one of the first and second axes.

13. A variable microwave stripline power divider, as described in claim 1, wherein said at least one ground plane member comprises:

a first ground plane member disposed on one side of the patch member; and a second ground plane member disposed on an opposite side of the patch member.

* * * * *